United States Patent [19]

Van Dyke

[11] Patent Number: 4,601,502

[45] Date of Patent: Jul. 22, 1986

[54] DOOR STOP ASSEMBLY

[76] Inventor: James R. Van Dyke, P.O. Box 2638, Redwood City, Calif. 94064

[21] Appl. No.: 730,787

[22] Filed: May 6, 1985

[51] Int. Cl.[4] ..... E05C 1/16

[52] U.S. Cl. ..... 292/252; 292/332; 292/150; 292/DIG. 15

[58] Field of Search ..... 292/332, 252, 150, 153, 292/175, DIG. 4, DIG.15; 403/DIG. 328; 192/150

[56] References Cited

U.S. PATENT DOCUMENTS

| | | | |
|---|---|---|---|
| 2,264,962 | 12/1941 | Adams | 292/147 |
| 3,073,192 | 1/1963 | Beers | 403/328 X |
| 3,330,585 | 7/1967 | Pollin | 292/153 X |
| 4,265,320 | 5/1981 | Tanaka et al. | 292/150 X |
| 4,462,623 | 7/1984 | Grant | 292/DIG. 4 |

FOREIGN PATENT DOCUMENTS

| | | | |
|---|---|---|---|
| 745108 | 2/1944 | Fed. Rep. of Germany | 292/252 |

*Primary Examiner*—Richard E. Moore
*Attorney, Agent, or Firm*—Paul L. Hickman

[57] ABSTRACT

A door stop assembly for vertical insertion in a single hole in a floor in the path of a swinging door includes a tubular housing with a top flanged housing for retaining the assembly in the floor, a tubular door check rod within the flanged housing and spring biased to extend up into the path of the door upon being triggered, and a trigger bar coaxially extending through the door check rod. The top surface of the trigger bar is normally flush with the flange so that the door check cannot be accidentally extended by merely stepping on it. When depressed below the flange surface, a steel ball, normally contained within two aligned radial holes in walls of the door check bar and housing, drops into an annular groove in the trigger bar to thus release the door check bar from its housing. When the door check bar is pushed down, the groove in the trigger bar replaces the ball in the aligned holes to relock the check bar in its housing.

12 Claims, 5 Drawing Figures

DOOR STOP ASSEMBLY

BACKGROUND OF THE INVENTION

1. Field of the Invention

This invention relates generally to door stops and particularly of a novel, selectively activated, tubular door stop for installation in a single hole in a floor within the arc of a swinging door and which is easily removable for repair or service.

2. Description of the Prior Art

There are numerous and various types of foot operated, door stop devices in the prior art which, when properly mounted in a floor within the arc of a swinging door, permit the door to pass over the top end of the stop member when in the inoperative position and which, when triggered, raise the stop member to check further opening of the door. Typical door stops in the prior art are U.S. Pat. No. 1,967,790 To Tarrant which discloses a housing containing a vertically positioned, spring loaded rod which is normally depressed so that a door may pass above the end of the rod, and which is released to spring up to check a door by depressing a foot button mechanically linked to trigger the rod.

Typical other similarly operated prior art devices are disclosed in U.S. Pat. Nos. 4,303,206 to Volpi and 3,330,585 to Pollin. All of these door stop devices may operate quite satisfactorily, but all suffer from the one common disadvantage that requires the release of the door check rod to its operating position by depressing a foot operated release or trigger button that extends above the floor surface near the door stop assembly. Thus, the door check rod may be accidentally actuated by merely walking near the door stop, a normal feat when entering or leaving through the door. If such a prior art door stop is installed to check a residential exterior door, accidental actuation of the door stop may readily result in accidental lock-out with the inability to open the door by the usual lock key, in a devastating temporary delay in receiving emergency held and/or a temporary lock-in during fires or other panic conditions.

The door stop to be described and claimed herein includes a spring biased door check rod but one which cannot be accidentally released to its operative position. Therefore, when installed to check a residental exterior door, there is no danger of accidental or unintentional lock-out or lock-in.

BRIEF SUMMARY OF THE INVENTION

OBJECTS OF THE INVENTION

One principal object of the invention is to provide a door stop which cannot be accidentally extended to its operative position and which can be recessed from its operative position to a locked inoperative position by merely stepping down on the extended door stop member.

Another object of the invention is to provide a door stop which is removably insertable into a single hole in a floor and within the arc of a door swing and which is substantially flush with the floor surface while in its inoperative position.

Still another important object is to provide a door stop which is reaily dissembled for repairs and easily and quickly reassembled.

Briefly described, the door stop of the invention includes three coaxial tubular members and an inner trigger rod. A flanged tube, open at its flanged end is screwed within an outer protective tubular housing and is adapted to be mounted in a hole in a floor at a location within the arc formed by a swinging door. A tubular door check rod is slideably positioned within the flanged tube and is biased by a spring between the closed lower ends of the check rod and flanged tube to extend out of the bore of the tube and its flange. Within the bore of the tubular door check rod and coaxial therewith is a solid trigger rod that is also biased by a spring between its lower end and the closed lower end of the check rod, and near the trigger rod lower end is an annular semicircular groove for receiving a steel locking ball normally housed between a radial hole in the wall of the tubular door check rod and a corresponding opening in the wall of the flanged tube. When the trigger rod is raised by its biasing spring, its upper end is substantially flush with the surface of the flange and the annular groove in the trigger rod is misaligned with the radial hole in the check rod so that the housed locking ball engages the radial holes in both the tubular check rod and the flanged tube. This locks the check rod in its lower or inoperative position. When the trigger rod is depressed below the surface of the tube flange, the locking ball is removed from the hole in the flanged tube and enters the trigger rod goove to thereby release its lock between door check rod and flanged tube. The spring biased check rod is then released to its operating position to check the opening of the door. Thus, the top end of the trigger rod for releasing the door check rod is normally flush with the top of the flange and is thus inoperable by merely stepping on the flange, but is released to its operative position by pressing the trigger rod below the level of the flange.

These and other objects and advantages of the invention will become apparent upon a reading of the following description and study of the drawings.

BRIEF DESCRIPTION OF THE DRAWINGS

In the drawings which illustrate the preferred embodiment of the invention.

DETAILED DESCRIPTION OF THE PREFERRED EMBODIMENT

Figure 1:
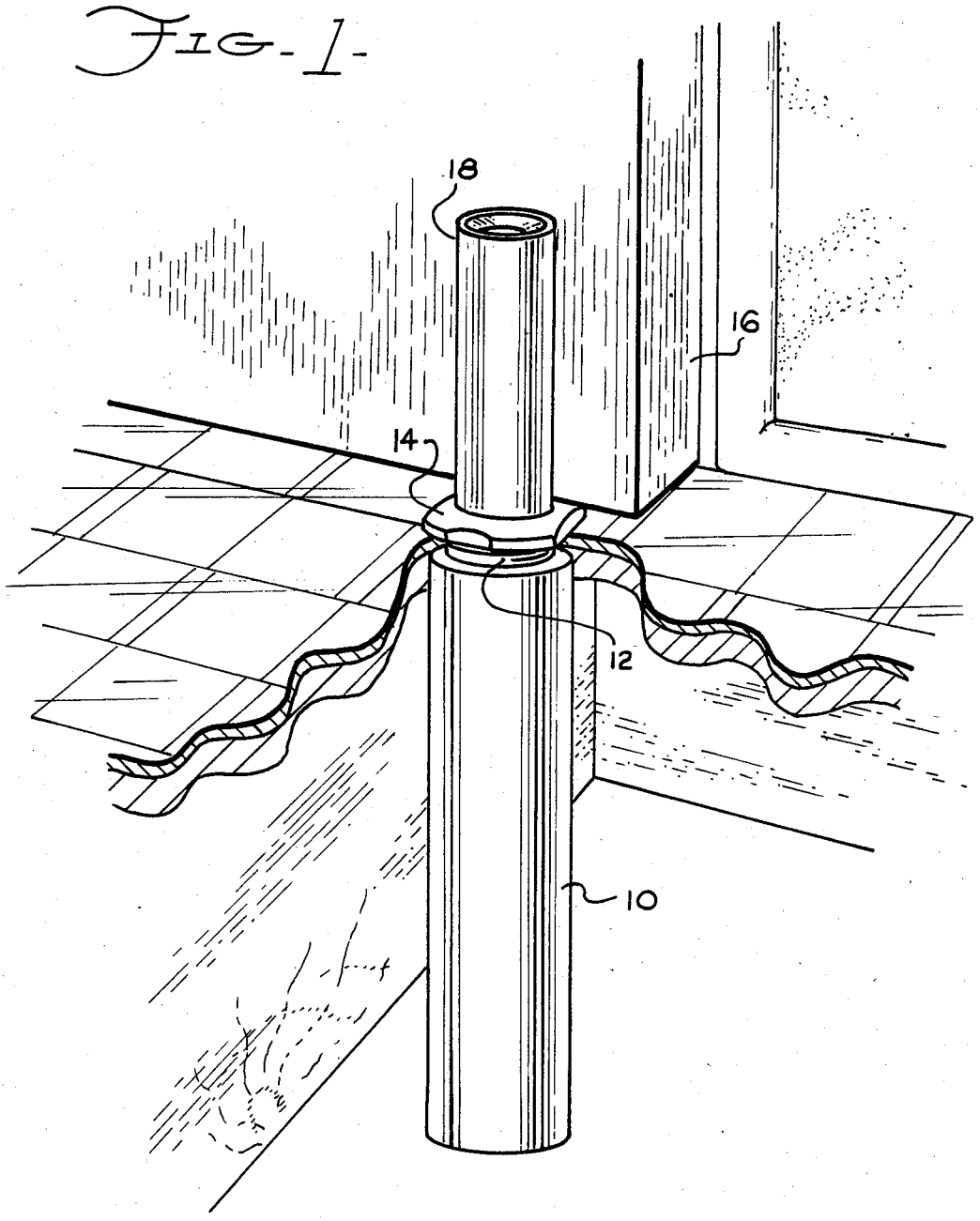
FIG. 1 is a perspective view, partially is section, illustrating the installation of the door stop assembly in a floor in front of a door.

As illustrated in FIG. 1, the door stop assembly includes a tubular housing 10 approximately one inch in diameter and four inches in length and closed at its lower end. Removeably mounted within the bore of the housing 10 is a flanged tube 12 having a flange 14 at its upper end and closed at its lower end within the housing 10. The thin flange 14 is preferably approximately one-eighth inches in thickness and, so that the flange may be grasped by pliers or a wrench, preferably has four edge flats cut from a circular flange of approximately 1.5 inches in diameter.

As illustrated in FIG. 1, the door stop assembly is mounted by inserting the housing 10 in a suitable hole in a floor and in the path of a swinging door 16. The very thin flange 14 will normally clear the bottom of the door without the necessity of recessing the flange into a larger clearance hole.

Figure 2:
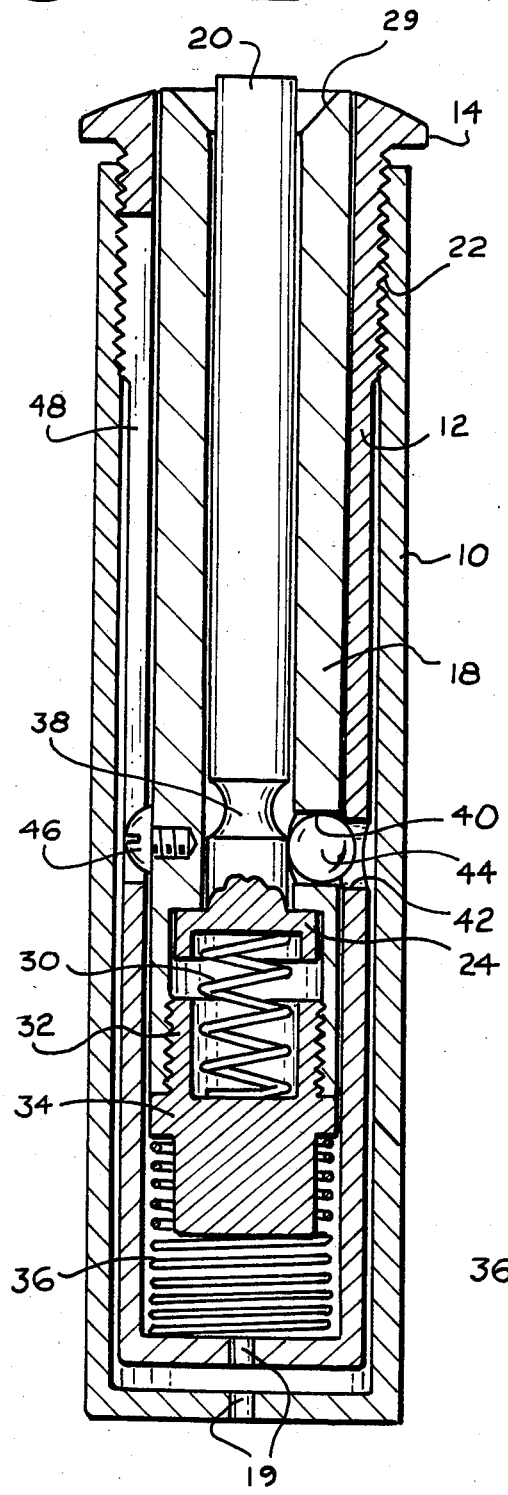
FIG. 2 is a sectional elevational view illustrating the door check rod down and locked within the housing.
Figure 3:
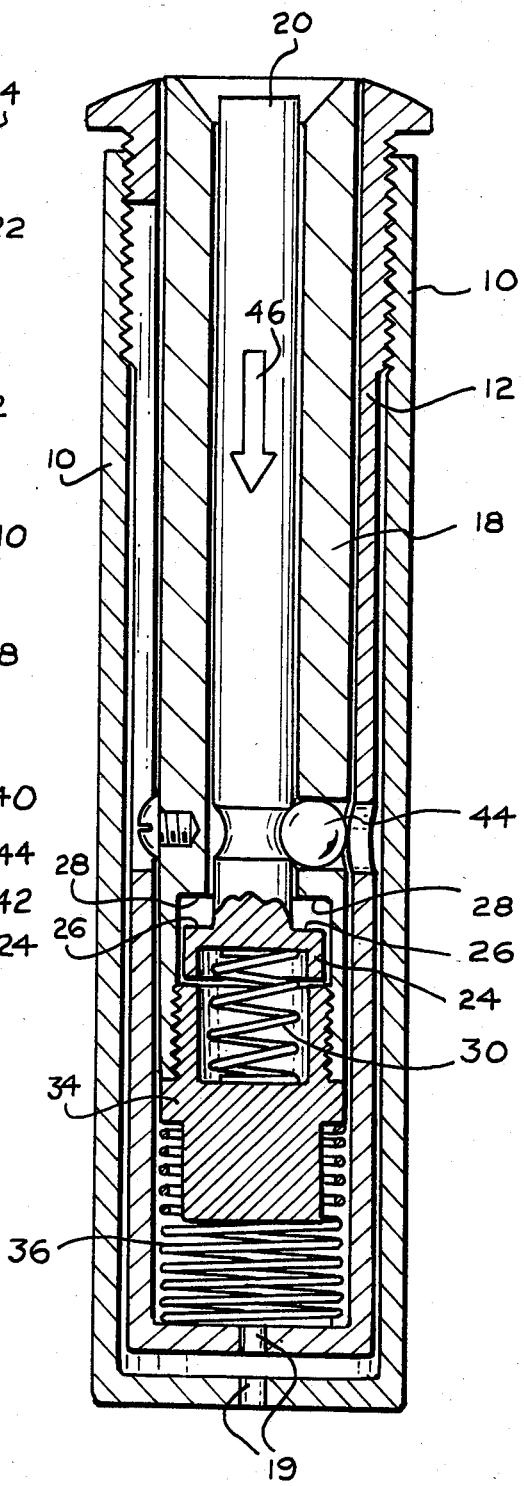
FIG. 3 is a sectional elevational view illustrating the release of the check rod to its operative position by depressing the trigger rod.
Figure 4:
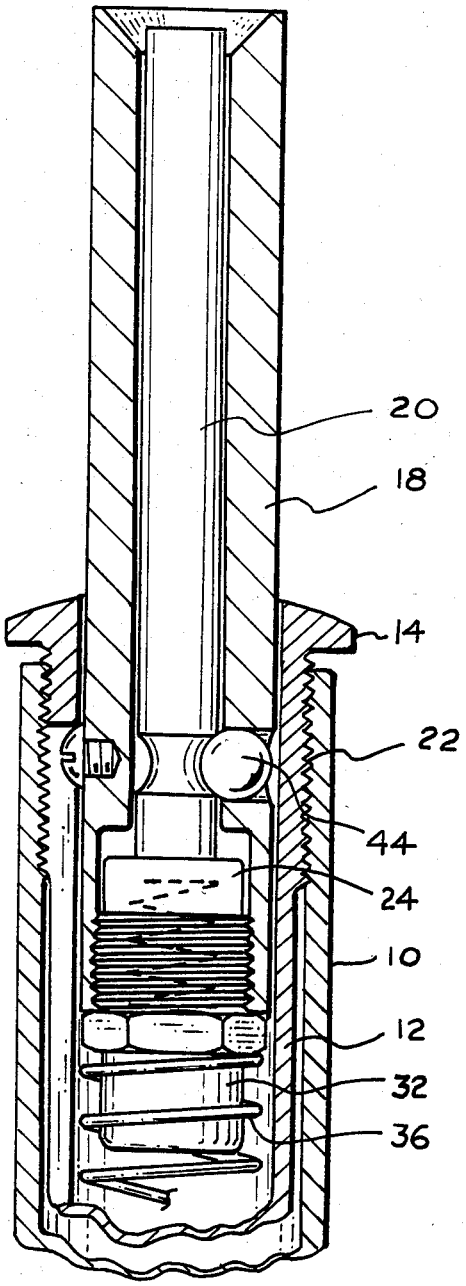
FIG. 4 is a sectional view illustrating the door check rod in its upper or operative position.

FIGS. 2, 3 and 4 are sectional views of the door stop assembly and illustrate in detail its construction and operation. The stop assembly includes three coaxial tubular members, the outer housing 10, the flanged tube 12, the tubular door check rod 18, and an inner solid trigger rod 20 within the door check rod 18. All three of the tubular members are open on top and, except for small air vent openings 19, are closed at their lower ends, and all members including the inner trigger rod 20 are longitudinally slideable within their neighboring tube except for the flanged tube 12 which is removably attached by a threaded section 22 to the outer housing 10. As illustrated in the drawings, the top open end of the tubular door check rod 18 is funnel shaped and its top end is substantially flush with the top surface of the flange 14.

The solid trigger rod 20 longitudinally slideable within the tubular door check rod 18 is formed at its lower end with a cup section 24 having a larger diameter than that of the rod 18 and which is slideable within a counterbored lower end of the tubular door check rod 18. Thus, the shoulder 26 on the cup section 24 will rest against a corresponding shoulder 28 in the check rod 18 counterbore to restrict the longitudinal movement of the trigger rod 20 and prevent its removal from the check rod 18. The bowl of the cup section 24 receives one end of a compression spring 30 which operates to urge together the shoulders 26 and 28 and thus bias the trigger rod toward the open end of the check rod. The length of the trigger rod 20 is such that its upper end is within the funnel shaped end 29 of the tubular check rod 18 and substantially flush with the flange 14 when the shoulders 26 and 28 are seated.

The second end of the compression spring 30 is seated in a cup 32 which is threaded to the lower end of the tubular door check rod 18 for ease in assembly and disassembly. The cup 32 has an annular ring section 34 with an outside dimension slightly less than the inside diameter of the flanged tube 12, and supports a first end of a second compression spring 36, the second end of which bears against the closed lower end of the flanged tube 12. Thus, the force of the spring 36 against the cup 32 on the tubular door check rod 18 operates to urge both the check rod and its contained trigger rod from the flange end of the flanged tube 12.

Located above the cup section 24 and formed in the shaft of the trigger rod 20 is an annular groove 38 with a semi-circular cross section. Located approximately one quarter inch below the location of groove 38, when the upper end of the trigger rod is flush with the top surface of the flange 14 as illustrated in FIG. 2, is a radial hole 40 through the wall of the tubular door check rod 18, and a similar radial and coaxial hole 42 through the wall of the flanged tube 12. Located in the holes 40, 42 in the tube wall is a steel spherical ball 44 having a slightly smaller diameter than the hole diameters. The ball 44 is prevented from falling from the adjacent exterior wall of the flanged tube 12 by the close presence of the outer housing 10.

When the trigger rod 20 is raised to its uppermost position as shown in FIG. 2, the misalligned annular groove in the rod prevents the ball 44 leaving its position between the flanged tube 12 and the door check rod 14. The check rod is thus locked to the flanged tube and the housing 10 and its upper end cannot extend beyond the surface of the flange 14.

When the trigger rod 20 is depressed by a cane tip, finger, or the like, as indicated by the arrow 46 in FIG. 3, so that its upper end becomes recessed within the funnel end 29 of the door check rod the annular groove becomes aligned with the hole 40 in the wall of the door check rod and the ball 44 is forced by the spring biased check rod from the hole 42 in the flanged tube 12 and into the annular groove. The lock formed by the ball within both holes 42 and 44 is now released and the door check rod 18 is free to be raised up into its operational position, as illustrated in FIG. 4, by the biasing action of the spring 36.

It will be noted that when the door check rod 18 begins its upward extension the ball 44 is held within the annular groove 38 and hole 42 by the interior wall of the flanged tube 12 so that the trigger rod 20 must move with the check rod. The upper limit of door check rod extension is controlled by a short machine screw 46 threaded into the outer wall of the check rod and preferably approximately opposite the position of the radial hole 40. Screw 46 has a head that extends into a narrow longitudinal slot 48 through the wall of the flanged tube 12 as best shown in the parts breakdown drawing of FIG. 5. The slot and screw combination restrict axial rotation of the door check rod in the flanged tube and limits the longitudinal movement of the door check rod to prevent removal of the check rod from the flanged tube and unintentional disassembly of the door stop assembly.

When it is desired to depress the door check rod so that the door may be opened, it is only necessary to step down on the top of the check rod. The trigger rod 20 moves down with the check rod 18 and when the annular groove 38 and hole 40 become substantially aligned with the radial hole 42 in the wall of the flanged tube 12, the upward spring bias on the trigger rod 20 forces the ball from the groove 38 and permits the trigger rod to move upward within the door check rod. The ball thus locks together the flanged tube 12 and the door check rod 18 as shown in FIG. 2.

Figure 5:
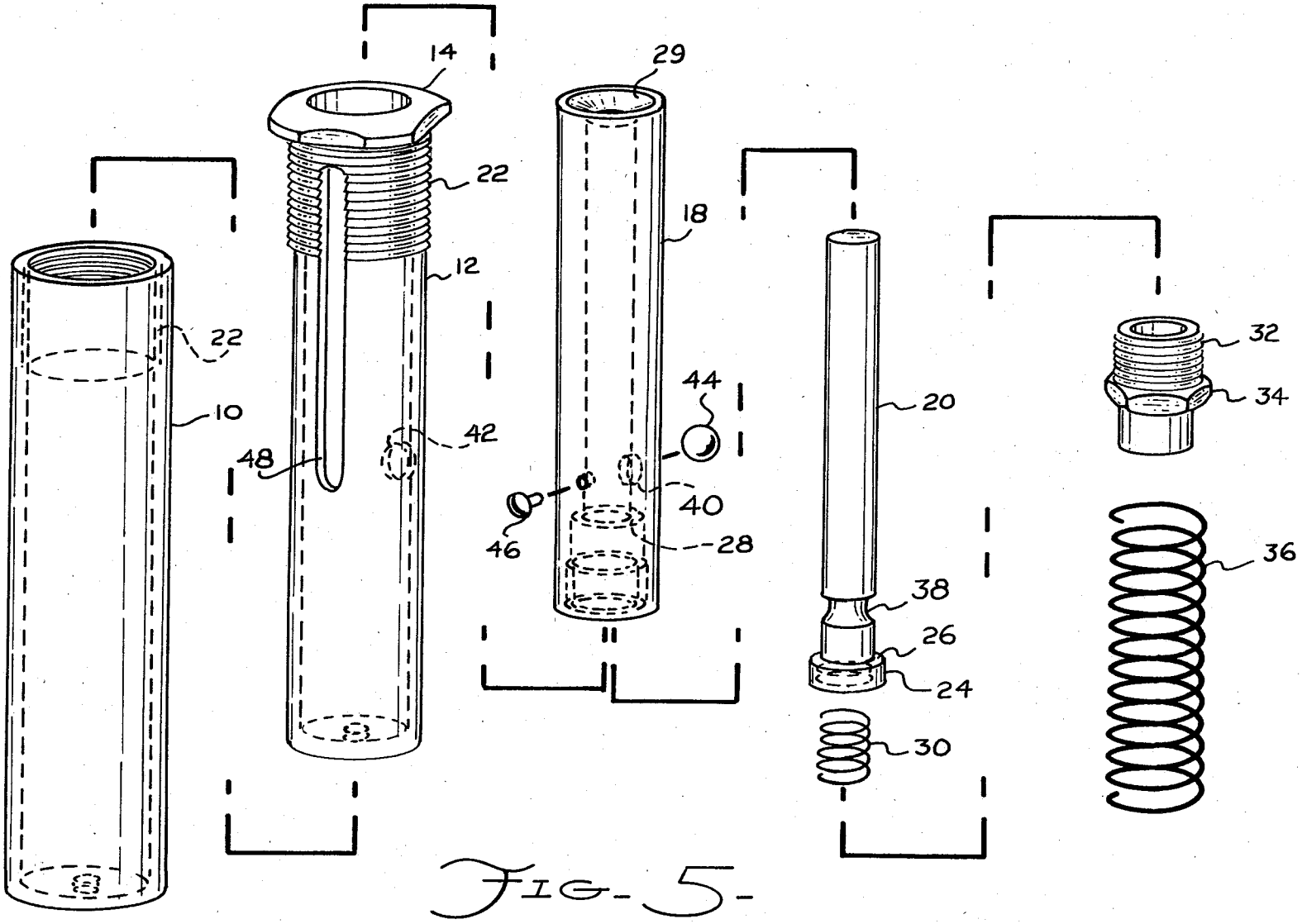
FIG. 5 is a view illustrating the several component parts of the door stop assembly.

FIG. 5 separately illustrates the various parts and components of the door stop assembly described above. The components are numbered according to the reference numerals described above and a description of the components of FIG. 5 are deemed unnecessary for a further understanding of the door stop assembly.

It will be noted that the door stop assembly may be easily and quickly disassembled in the event of a broken spring or other problems. To effect such disassembly, the flanged tube 12 is first unscrewed from the housing 10. The removal of the screw 46 from the door check rod 18 and the longitudinal slot 48 enables removal of the rod 18, trigger rod 20 and ball 44 from the flanged tube 12 and permits removal of the spring 36. Cup 32 may then be unscrewed from the lower end of the door check rod 18 to permit access to the spring 30. To reassemble the door stop only requires a reversal of the above process.

Having thus described my invention, what I claim is:

1. A door stop assembly for installation in a floor having a floor surface over which a door may swing along an arcuate door path, said door stop assembly comprising:

an elongated tubular housing for vertically mounting in the floor, said housing having an open first end positioned proximate said floor surface, and a closed second end;

an elongated tubular door check rod longitudinally movable within said tubular housing between a retracted first position wherein a first end of said check rod is positioned proximate said floor surface and an extended second position wherein said first end is substantially above said floor surface and in the arcuate door path;

biasing means disposed within said housing for urging said tubular door check rod from said first position to said second position;

locking means coupled between said tubular housing and said tubular door check rod; and a trigger bar coupled to said locking means for selectively unlocking said locking means, said trigger bar having first and second ends, said trigger bar being longitudinally movable between first and second operating positions within said tubular door check rod, in said first operating position the first end of said trigger bar is positioned proximate the first end of said door check rod and said door check rod is locked in its retracted first position by said locking means, in said second operating position the first end of said trigger bar is recessed below the first end of said door check rod and said door check rod is unlocked by said trigger bar to move to its extended second position.

2. The door stop assembly claimed in claim 1 wherein the bore of the first end of said elongated tubular door check rod is funnel shaped to enable the positioning of said trigger bar between its first and second operating positions.

3. The door stop assembly claimed in claim 2 wherein said tubular housing includes an outer first tubular member and a second tubular member removably coupled to said outer first member, said first and second members having a first open end and a second closed end each of which have air passage apertures therein, the first end of said second tubular member having a flange for supporting the door stop assembly in the floor.

4. The door stop assembly claimed in claim 3 wherein said elongated tubular door check rod is longitudinally movable within said flanged second tubular member, and wherein said biasing means includes a compression spring located between a closed second end of said tubular door check rod and the closed second end of said flanged second tubular member.

5. The door stop assembly claimed in claim 4 further including a spherical ball positioned within aligned radial holes through the walls of said tubular door check rod and said flanged second tubular member, said ball locking said check rod to said flanged member.

6. The door stop assembly claimed in claim 5 wherein the removal of said spherical ball from the exterior of the hole in said tubular flanged second tubular member is prevented by the interior surface of said outer tubular member or said housing.

7. The door stop assembly claimed in claim 5 wherein the surface at a first location on said trigger bar retains said ball within said aligned radial holes when said trigger bar is in its first operating position.

8. The door stop assembly claimed in claim 7 wherein said trigger bar has an annular groove at a second location in its surface, said second location being substantially at a point of alignment with said aligned radial holes when said trigger bar is in its second operating position, said annular groove being shaped for receiving a portion of said spherical ball and for permitting removal thereof from the radial hole through the wall of said flanged second tube to thereby release the lock between said flanged tube and said tubular door check rod.

9. The door stop assembly claimed in claim 8 further including second spring biasing means interposed between the closed end of said tubular door check rod and the adjacent second end of said trigger rod for urging said trigger rod toward its first operating position.

10. The door stop assembly claimed in claim 9 wherein axial rotation is restricted and longitudinal movement of said tubular door check rod is limited by protruding means coupled to the exterior wall of said door check rod and slideably movable within a longitudinal slot in the adjacent wall of said flanged second tubular member.

11. The door stop assembly claimed in claim 10 wherein said protruding means is a screw threaded into the wall of said door check rod, said screw having a head protruding into said longitudinal slot.

12. A door stop assembly for installation in a floor having a surface over which a door may swing, said door stop assembly comprising:

an elongated tubular outer housing having an open first end and a closed second end with an air passage vent therethrough, a section of the bore of said housing being threaded;

a second tubular member having a flange at its first end and closed second end with an air passage vent therethrough, said second member being slideably mounted within the bore of said outer housing and having a portion of its outer surface threaded for engagement with the threaded bore of said outer housing, said second tubular member having an elongated longitudinal slot through a portion of its wall and a radial hole through a second portion of its wall;

a tubular door check rod slideably positioned within the bore of said second tubular member, the first end of said check rod being substantially flush with the surface of said flange and being funnel shaped, the bore at the second end of said check rod being threaded, said check rod having a threaded radial hole having therein a screw member having a head portion confined within the elongated longitudinal slot in the wall of said second tubular member, said check rod having at least one radial hole for housing a spherical locking ball, said radial hole being substantially coaxial with said radial hole in the wall of said second tubular member;

a spherical locking ball positioned with the radial holes in said door check rod and said second tubular member for preventing relative longitudinal movement between said tubular member and said check rod;

a trigger rod slideably positioned within the bore of said tubular door check rod, the first end of said trigger rod being positioned proximate to the surface of said flange and the top surface of said funnel shaped first end of said door check rod, the second end of said trigger rod being cup shaped, said trigger rod having an annular groove at a location slightly above the location of said spherical locking ball whereby depressing said trigger rod will permit said locking ball to be disengaged from said second tubular member;

a cup member engaging the threaded bore at the second end of said check rod;

a first spring between the closed second end of said second tubular member and said cup member on said door check rod for urging said door check rod from said second tubular member upon the disengagement of said locking ball from said second tubular member, the longitudinal movement of said door check rod being limited by said screw member in said longitudinal slot; and a second spring between said cup member and the second end of said trigger rod for raising said trigger rod and disengaging said spherical locking ball from said annular groove when said door check rod is depressed to the position at which its first end is substantially flush with the surface of said flange.

* * * * *